United States Patent [19]

Gatland et al.

[11] 4,055,023

[45] Oct. 25, 1977

[54] DOOR OPERATOR WITH INSTANT REVERSE FEATURE

[75] Inventors: Geoffrey H. Gatland, Walled Lake, Mich.; Kenneth L. Robitaille, Windsor, Canada

[73] Assignee: Vemco Products, Inc., Detroit, Mich.

[21] Appl. No.: 584,620

[22] Filed: June 6, 1975

[51] Int. Cl.[2] ..... E05F 15/12

[52] U.S. Cl. ..... 49/28; 318/265; 318/467

[58] Field of Search ..... 49/26, 28, 200, 360; 318/266, 265, 467, 468

[56] References Cited

U.S. PATENT DOCUMENTS

| | | | |
|---|---|---|---|
| 1,408,424 | 2/1922 | Grebler et al. | 49/28 X |
| 2,882,044 | 4/1959 | Ginte | 318/266 |
| 3,733,747 | 5/1973 | Fox et al. | 318/266 X |

FOREIGN PATENT DOCUMENTS

| | | | |
|---|---|---|---|
| 1,236,760 | 6/1971 | United Kingdom | 49/28 |

*Primary Examiner*—Kenneth Downey

*Attorney, Agent, or Firm*—Krass & Young

[57] ABSTRACT

An improved garage door operator of the motor-driven chain-and-sprocket type comprising a molded plastic gear case assembly supporting an output shaft for rotation relative thereto. A molded plastic worm wheel is loosely disposed on the shaft for limited rotation relative thereto and is driven by a reversible electric motor through a worm. Camming surfaces on the worm wheel and a second element which is fixedly disposed on the shaft form a low-torque coupling such that under normal conditions the motor drives the shaft to move the garage door. If the door encounters an obstacle and is unable to move, continued rotation of the motor drives the cam surface of the second element up the cam surface of the wheel so as to axially shift the second element relative to the gear case to trip a reversing switch. Up and down limits are established by means of a small threaded shaft which is driven off of the worm wheel and which produces linear displacement of a limit switch actuator traveler. The traveler carries adjustable dogs which operate respective limit switches in a limit switch carrier which is mounted on the gear case.

14 Claims, 12 Drawing Figures

DOOR OPERATOR WITH INSTANT REVERSE FEATURE

INTRODUCTION

This invention relates to power operators for garage doors and the like.

BACKGROUND OF THE INVENTION

Power operators for garage doors and the like generally comprise reversible electric motors connected to the garage door by means of a chain and pulley arrangement and provided with suitable controls to stop the motor at predefined limits of door travel. The typical operator comprises a case made out of stamped metal parts which are fastened together with machine screws, nuts and bolts, and the like, a small electric motor, a speed reducer, some kind of clutch, and a chain and sprocket or pulley drive system.

In one prior art system shown in U.S. Pat. No. 2,672,582 the drive motor is caused to be shut-off at the up and down limits of door travel by sensing the fact that the door encounters a mechanical obstacle; e.g., the floor of the garage or the top limit of the door carriage. Motor shut-off is accomplished by means of a camming clutch arrangement on the motor output shaft which shifts a collar axially along the output shaft to trip a shut-off switch. More specifically, this is provided by means of a pair or collars having a ramp-like meshing combination of cam surfaces, one collar being fixed on the output shaft and the other being loosely disposed on the output shaft. When the door encounters a mechanical obstacle, the motor continues to rotate the fixed collar, but the loose collar which is connected to the door begins to slip and the cams cause an axial shaft of one collar relative to the other. When the free collar slides away from the fixed collar, a switch is thrown to stop the motor.

There are a number of disadvantages to this prior art system including the fact that the clutch arrangement is operative for every half cycle of door travel and thus must be of extremely durable construction to avoid deterioration in an unacceptably short time. Even with a durable clutch, the operation of stopping the door by running it against a mechanical stop at full speed is bound to produce a good deal of wear on the door, the motor, and the various other components of the operator. Perhaps most importantly is the fact that such a device has the capability of trapping a small child under the door until help arrives to restart the motor in the opposite direction. Finally, the prior art system described above fails to provide for the adjustment of the limit stops.

A more practicable approach to the provision of limit stops is disclosed in U.S. Pat. No. 2,951,920. The system disclosed in that patent provides for a small threaded shaft which is rotated in synchronism with the drive shaft of the operator and which is further provided with a pair of traveler nuts which are held against rotation and which thus travel linearly along the threaded shaft as the output shaft of the operator rotates. The system futher comprises a pair of limit switches which are actuated by the fixed traveler nuts so as to stop the motor at each of adjustable up and down limits of travel. Thus the door is stopped by opening a motor control switch and not by running the door against a mechanical stop.

In addition, the feature of obstacle detection is best provided by means for causing an instant reversal of the direction of motor shaft rotation such that the motor does not merely stop, but actually backs away from the obstacle. This approach, however, calls for a mechanism to disarm the instant reverse just before the door reaches bottom so that the ordinary closing function can not produce a reversal.

The invention of the disclosure herein relates to systems of the second type described above; i.e., a garage door operator of the type providing adjustable limits along with an obstacle detector of the instant reverse type.

BRIEF SUMMARY OF THE INVENTION

As set forth immediately above, the subject invention relates to improvements in the design and manufacture of garage door operators of the type having a small drive motor and an output shaft from which mechanical power to drive a door is provided. Moreover the invention relates to garage door operators of the type having adjustable travel limits. As will be hereinafter described in greater detail the preferred embodiment of the invention comprises a number of components which are most advantageously constructed of molded plastic material. For example, the preferred embodiment comprises a molded plastic gear case which provides support for a main drive shaft, a small threaded shaft which is involved in the limit stop assembly, and various other parts including limit switch carrier and limit switch actuator elements.

Although the invention is described herein as being embodied in an operator having a chain and sprocket drive system it is equally applicable in many respects to screw drive operator systems; i.e., those systems where the operator and the door are interconnected by an elongated screw shaft, the traveler for which comprises a fixed nut which is mechanically connected to the door. As an example, the following features of the invention may be used individually as well as in combination in operators of various types: (1) the overload-detecting instant-reverse feature of the invention comprising first and second cam elements which are positioned in the drive train so as to produce a limited axial shift of the second cam element under stalled conditions, such axial shift being such as to immediately reverse the motor travel; (2) an improved limit switch assembly including improved means for mounting the limit switch actuator shaft in the gear case, (3) an improved mechanism for mounting the limit switches, (4) an improved mechanism for actuating the limit switches including a snap-on traveler and adjustable dog assembly; and various other features which will be set forth in detail in the detailed description of the specific embodiment.

DETAILED DESCRIPTION OF THE SPECIFIC EMBODIMENT

A. Power Drive and Instant Reverse

Figure 1:
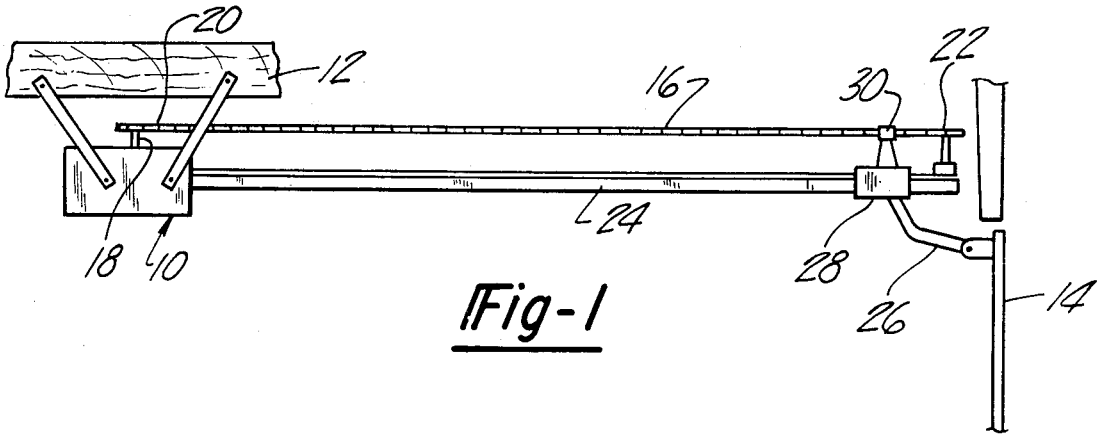
FIG. 1 is a side view of a typical garage door power operator installation.

FIG. 1 shows a typical power garage door operator installation to comprise the power operator 10 suspended from a garage ceiling joist 12 and connected to a pivotal overhead door 14 by way of a drive chain 16. The door is typically mounted in a carriage having up and down limits of travel and is shown in the down limit of travel wherein the bottom edge of the door is adjacent the garage floor (not shown). Chain 16 is engaged around sprocket 20 at the operator end, such sprocket being mounted on the end of output shaft 18 driven by a motor within the housing of operator 10. The other end of chain 16 is engaged with a idler sprocket 22 on rail 24, the chain 16 being connected into a closed loop either by chain links or by a length of substantially inextensible cable.

To produce movement of the door 14 corresponding to movement of the chain 16, a linkage 26 connects the door 14 to a traveler unit 18 which is slidably mounted on the fixed rail 24 extending between the operator 10 and a point immediately adjacent and above the door opening as shown. The traveler 28 is mechanically interconnected with the chain 16 by means of a latch 30 such that traveler 28 moves back-and-forth in a shuttle-like pattern as the operator 10 is actuated in respective half cycles of operation.

FIGS. 2 through 9 illustrate details of the internal mechanism of the operator 10, it being understood that the points of novelty in the subject invention lie in the improved construction of the operator 10 rather than in the overall assembly as has been described with reference to FIG. 1. Moreover, the invention is not dependent upon the specific nature of the drive system or the components thereof such as chain 16, the rail 24, the traveler 28, the linkage 26, the door 14, or any combination of these devices.

The device of FIGS. 2 through 9 comprises a motor drive operator 10 in which many of the major components, the counterparts of which have heretofore been manufactured from stamped metal, are most expeditiously fabricated from molded plastic. This construction offers considerable reduction in weight, ease of assembly, economy, long life and generally improved operation and user satisfaction. In general, the operator to be described is of the type comprising a rotatable output shaft 18 driven by a motor 50 to raise and lower the door 14 between open and closed limits of travel. It is to be understood that the terms "open", "closed", "up" and "down" are arbitrarily chosen because of the specific embodiment disclosed. However, the term is not intended to limit the applicability of the invention, as sliding doors, gates and various other types of movable appliances may be equally amenable to the application of the subject device. In addition, the operator 10 hereinafter described provides means for adjusting the up-and-down limits of travel and additional means for sensing the fact that the door has encountered an obstacle beyond which it cannot continue and from which it is necessary to reverse the direction of the door on a substantially instaneous basis.

Figure 2:
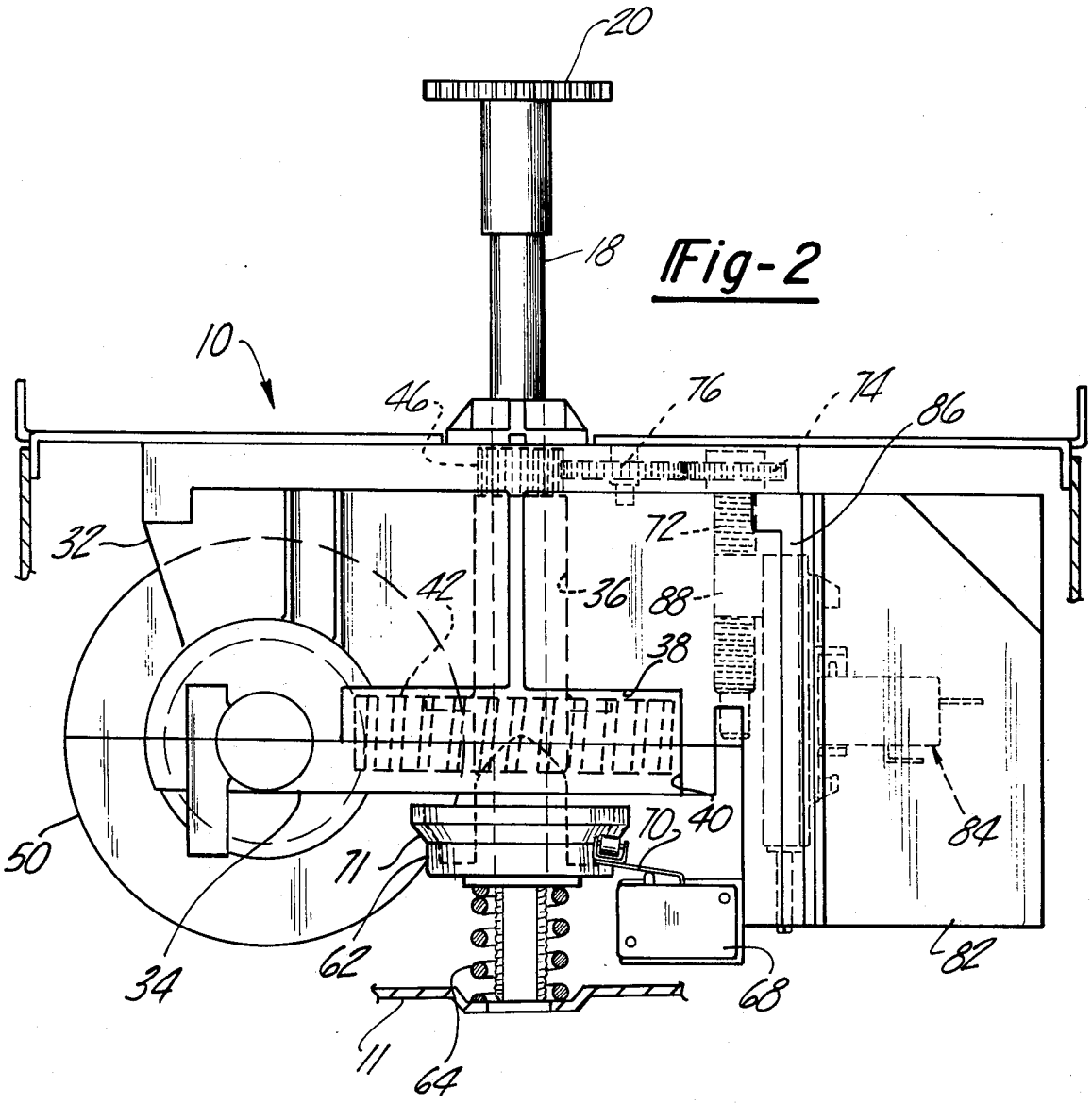
FIG. 2 is a side view, partly in section, of an operator embodying the novel inventive features set forth herein.
Figures 8, 9:
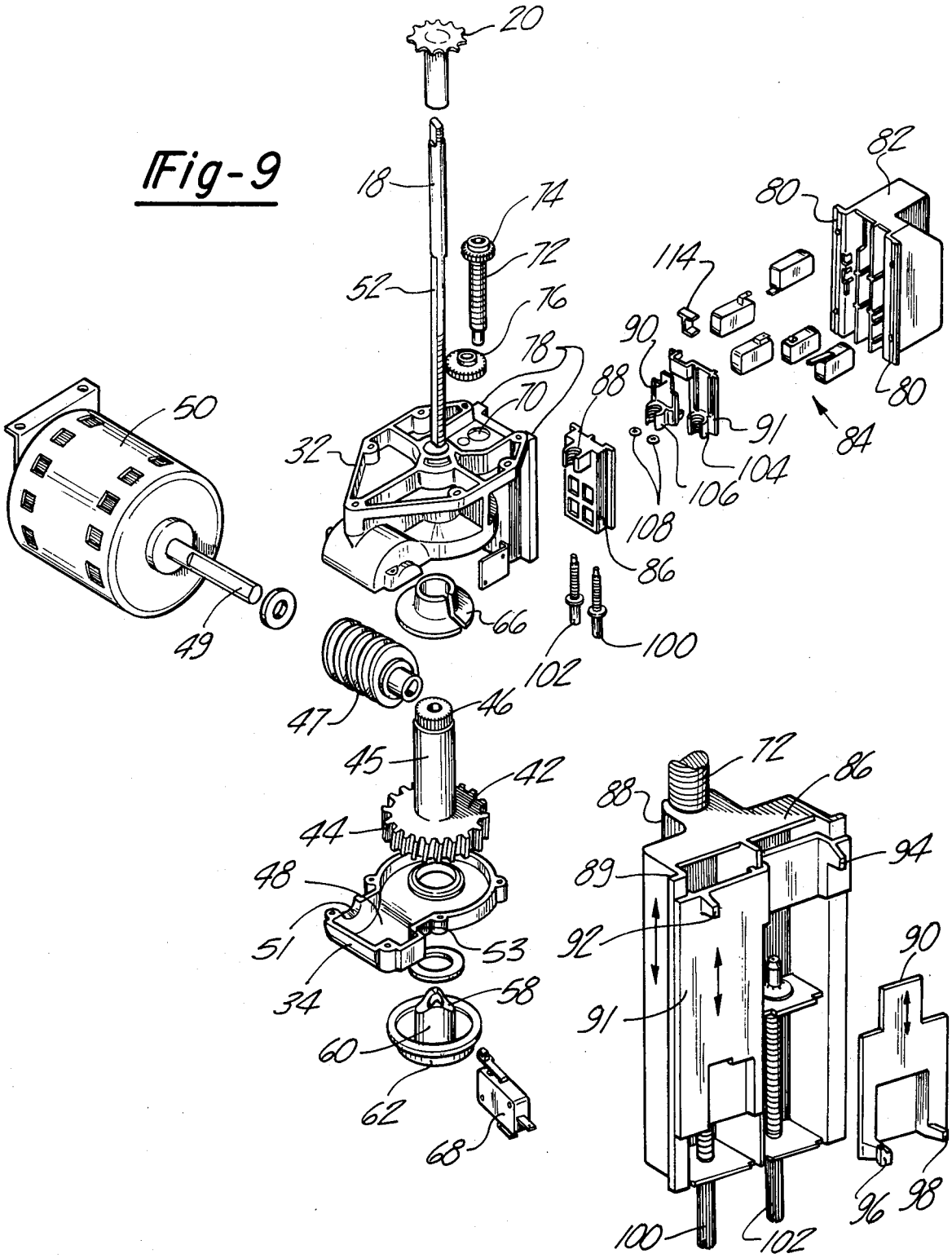
FIG. 8 is a perspective view of a limit switch actuator dog and traveler assembly.
FIG. 9 is an exploded view of the operator of FIG. 2 showing each of the various components of the operator in a partially disassembled state.

Looking to FIGS. 2 and 9 operator 10 comprises a molded plastic body comprising an upper gear case 32 and a lower gear case 34 of complemental configuration and being joined with the upper gear case unit 32 by suitable fasteners such as small screws. The assembled gear case 32, 34 comprises and defines a normally vertically oriented cylindrical cavity 36 defining integrally molded bearing surfaces and extending through the gear case to support the output shaft 18 for rotation therein. The shaft 18 is of steel construction and extends above the gear case body to receive the sprocket 20 as shown, and below the gear case body to accomodate a spring 64 the function of which will be hereinafter described. The upper gear case 32 is molded to define a thrust bearing surface 38 which flares outwardly from the inner diameter of the cavity 36 to the wall 40 of a coaxial receptacle 40 which is of increased diameter. Disposed within the two-part interior volume of cavities 36 and 40 is a molded plastic worm wheel 42 comprising a wheel portion having peripheral gear teeth 44 and a hollow shaft portion 45 which terminates at the upper extremity thereof in a drive pinion 46 for purposes to be described. Peripheral teeth 44 of wheel 42 mesh with a worm 47 which is disposed within another interior volume 48 of the gear case 32, 34 also having axially spaced, molded-in bearing surfaces 51 and 53. Worm 47 is mounted for rotation with the output shaft 49 of the drive motor 50. Worm 47 is keyed onto the motor output shaft 49 in the conventional fashion. Accordingly, when motor 50 is actuated, worm gear 47 rotates and produces corresponding rotation of wheel 42.

A split ring bearing collar 66 is preferably disposed about the shaft portion 45 of wheel 42 to reside between the wheel 42 and the upper gear case 32 to provide a self-lubricating highly efficient bearing. The fact that the ring 66 is split eliminates the need for a high precision injection molding operation.

Figure 4:
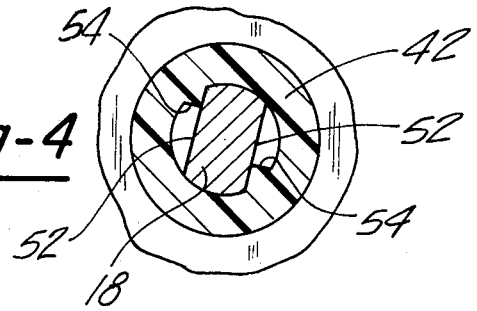
FIG. 4 is a sectional view along section line 4—4 of FIG. 3.
Figure 5:
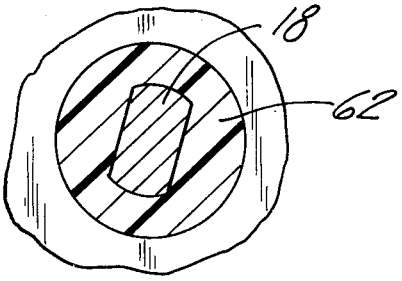
FIG. 5 is a sectional view along section line 5—5 of FIG. 3.

Looking to FIG. 4, the sectional view through the wheel 42, it can be seen that shaft 18 is provided along the lower length thereof with diametrically opposite flats 52 and the interior of the wheel 42, while generally of a cylindrical bore, is provided with radially inwardly projecting nibs 54. In addition, the wheel 42 is loosely (non-drivingly) disposed about the shaft 18 such that there is typically no direct driving connection between wheel 42 and shaft 18, but rather an indirect connection via a molded plastic cam wheel 62 which is fixed on shaft 18 for movement therewith rotationally and free to move on the shaft axially. The low-torque coupling between wheel 42 and wheel 62 provides not only drive power, but a component of an instant-reverse system is hereinafter described.

Since the wheel 42 is loosely disposed about shaft 18, it is not the primary drive connection between the output shaft 49 of motor 50 and the output shaft 18 of the operator. To provide this drive connection a low torque coupling is provided in the form of a first axially facing cam surface 56 formed integrally with the wheel 42 and comprising a continuous alternating configuration of lobes and troughs. A second cam surface 58 is provided on the cylindrical portion 60 of the cam wheel 62 which is radially fixedly disposed on the lower end of the shaft 18 to rotate therewith under all conditions. The cam surface 58 on cam element 62 is also characterized by a continuous alternating combination of lobes and troughs and thus meshes complementally with the cam surface 56 on wheel 42 to provide a torque coupling which operates in a non-slip mode for all torques below a predetermind value; i.e., value which is sufficient to move the door in the absence of an obstacle such as an automobile or a human body in the path of the door. However, the torque coupling provided by the meshing cam surfaces 56 and 58 is insufficient to stall the motor 50, in the face of an obstacle, but rather causes realtive slip to occur between the motor driven wheel 42 and the cam wheel 60 which is secured on the shaft 18. The nibs 54 limit such slip to about 75°.

Figure 3:
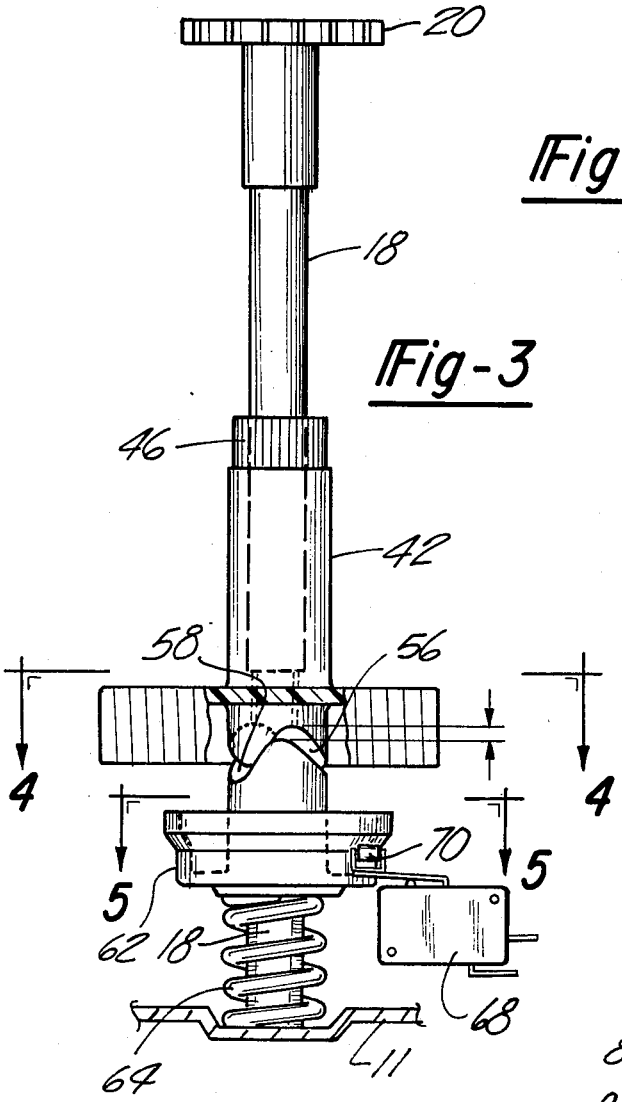
FIG. 3 is a side view, partly in section, of the drive train details of the operator of FIG. 2 in the axially shifted configuration.

FIG. 2 shows the two cam elements under ordinary no-slip conditions while FIG. 3 shows the cam elements 42 and 62 after considerable slip has occured. It will be apparent that the ramp-like configuration of the undulating cam surfaces has caused the cam 62 to move axially away from the gear case body 32, 34. Wheel 42 provides reaction force by pushing against the thrust bearing surface 38 previously described. The cam surfaces 56 and 58 are normally urged into the meshing non-slip configuration by a coil spring 64 which is disposed between the bottom surface of cam wheel 62 and the fixed stop 11.

Summarizing the drive system as it has been thus far described, reversible motor 50 drives worm wheel 42 by way of worm 47 meshing with peripheral teeth 44. As worm wheel 42 rotates within the gear case body 32, 34, torque is coupled to the cam wheel 62 by way of the cam surfaces 56 and 58, driving shaft 18. Rotation of output shaft 18 produces linear displacement of the chain 16 and the traveler 28 which is mechanically connected to the door.

This description of operation of course assumes that the door 14 is free to move. If an obstacle prevents the door 14 from moving, shaft 18 is held fixed whereupon motor 50 continues to drive wheel 42 causing the cam surfaces 56 and 58 to slip relative to one another as shown in FIG. 3. Slip between the cam surfaces causes an axial shifting of cam member 62 and reversal of motor 50 as hereinafter described.

The axial shift of the cam element 62 on the shaft 18 triggers an "instant reverse" operation which prevents the door from continuing to bear against an obstacle such as a human being. To accomplish this a limit switch 68 is mounted on the gear case 32, 34 with the actuator arm 70 thereof disposed against the annular collar 71 on the external surface of the cam wheel 62. The first quarter-inch or less of axial shift closes the limit switch 68 triggering the instantaneous reversal of motor 50 by means of the circuit illustrated in FIG. 10.

This circuit is well known by way of prior art devices and includes the instant reverse feature as well as the limit switches 84 for stopping the motor 50 at the opposite limits of travel. Thus, the axial shift of the cam wheel 62 signifies an overload condition caused by the door 14 encountering an obstacle. The result is to instantly reverse the direction of motor 50 to cause the door 14 to back away from the obstacle and prevent serious injury to persons or things which may be caught under the door.

As is also shown in FIGS. 2 and 3, the slope of the cam lobes is not uniform or symmetrical relative to a centerline of a given lobe but is steeper on the side which provides the reaction force while raising the door. The result is a non-uniform or non-symmetrical torque coupling capability such that a lesser torque causes the slip condition while lowering the door and a higher torque causes the slip condition while raising the door. The reason for this asymmetrical torque coupling capability is that raising the door require moving the door against its own weight and, moreover, it is far less likely that the door will encounter an obstacle when being raised than when being lowered.

B. Limit Switch Apparatus

The balance of the disclosure is directed toward the apparatus involved in establishing and adjusting the up and down limits of door travel.

As shown in FIGS. 2 and 9, gear case body 32, 34 provides a second hollow cylindrical cavity 70 with integral bearing holes to accommodate and support for rotation within the gear case a small threaded shaft 72 having a molded plastic gear 74 secured to the upper end thereof for rotation therewith. When disposed within the gear case 32, 34 in the manner shown in FIG. 2, plastic gear 74 is coupled with the gear 46 formed on the upper end of the worm wheel 42 by means of an idler gear 76 which is carried between vertically spaced plastic panels providing integral, molded bearings on the upper end of the gear case 32 adjacent the shaft 18. Thus, the worm wheel 42 operates as the direct drive instrumentality to the threaded shaft 72 such that the shaft 72 rotates with the output shaft 49 of motor 50. In the preferred form the axis of shaft 72 is parallel and closely adjacent the axis of shaft 18 such that a single idler gear interconnection may be employed.

Upper gear case element 32 has formed thereon adjacent the cavity 70 for shaft 72 a pair of spaced parallel mounting surfaces 78 which are grooved to precisely receive and locate the flanged mounting surfaces 80 of a limit switch carrier body 82 which is preferably molded of a suitable high-impact plastic material. Carrier body 82 is fastened to the gear case 32 by means of machine screws and houses in three parallel columns, a plurality of limit switches 84 which provide the various motor control function characterstics of a power garage door operator as is more fully described with reference to FIG. 10. These include limit switches for stopping the motor 50 at the up and down limits of travel and various other switches for auxiliary functions such as turning lights on and off. When mounted in the carrier body 82 the limit switches 84 are fixed in position relative to the gear case body 32, 34 where they may be actuated by a traveler assembly mounted on the shaft 72.

To operate the limit switches 84 a limit switch actuator traveler 86 having an integral molded plastic partial nut 88 is slidably mounted on the gear case 32 between the mounting surfaces 78 and threadedly engaging the shaft 72 as best shown in FIG. 8. Flanges 89 bear against the gear case 32 to prevent traveler 86 from rotating with the shaft such that rotation of the shaft 72 causes the slidable traveler 86 to move up and down the gear case body along an axis which is parallel to the axis of shaft 72. Traveler 86 carries in adjustable relationship thereto molded plastic plates 91 and 90 having dogs 92, 94, 96 and 98 projecting toward the limit switch banks to actuate the switches 84 at various linear positions of traveler 86. Dog plate 91 is vertically adjustable relative to the traveler body 86 by means of adjustment screw 100 and dog plate 90 is similarly adjustable by means of screw 102. Both screws 100 and 102 pass through two axially spaced ribs in traveller 86 and are locked in place by a flared flange on the shaft of each screw and a push nut 108 which is forced over the screw shaft end. The threaded shaft is thus exposed between the ribs to receive the snap-on molded plastic partial nuts 104 and 106 of the dog plates as shown in FIG. 9. Rotation of screw 100, for example, causes the dog plate 91 which is threadedly engaged with the threaded shank of the screw 100 to move up or down thus to adjust the exact position of the traveler 86 along shaft 72 at which actuation of one of the limit switches 84 is desired. Rotation of screw 102 produces a similar adjustment relative to dog plate 90. As shown in FIG. 9 the nut portions 104 and 106 of the dog plates 91 and 90, respectively, are again partial such that they may be snapped on to the screws 100 and 102 during assembly.

Because the dogs 92, 94, 96 and 98 on the dog plates 91 and 90 project toward the actuator elements of the conventional limit switches 84, rotation of the shaft 72 produces linear displacement of the traveler 86 and consequent operation of the limit switches at various positions of the door 14. In other words, as motor 50 rotates output shaft 18 through the aforementioned torque coupling comprising worm wheel 42 and cam wheel 62, it also rotates shaft 72 through the gear drive comprising gears 46, 76, 74. Thus, once calibrated, position of traveler 86 on shaft 72 is a mechanical analogy of and is proportional to the actual position of the door 14 between its limits of travel. Accordingly, a first limit switch may be established to stop the motor 50 at the down limit of travel and dog 98 may be employed to operate the stop feature actuator which in turn operates the down limit switch. Similarly dog 92 may be employed to operate the up limit switch which is disposed two columns over from the down limit switch in the limit switch carrier body 82 as previously described. The other limit switches are employed to turn the garage light on an off according to whether the door is opened or closed and to disarm the instant reverse feature just before the door reaches the bottom limit of travel. Since each of the dog plates 90 and 91 is independently adjustable on the traveler body 86 an infinite number of up and down limits may be provided thus to adapt the subject operator to substantially any commonly encountered installation situation.

Since the shaft 72 is driven from the wheel 42 rather than directly from shaft 18, it is necessary to prevent a loss of angular correlation between the actual position of the door 14 and the rotational position of shaft 72 which represents door position. This is accomplished by means of the flats 52 on the shaft 18 and the nibs 54 on interior surface of the wheel 42 as previously described with reference to FIG. 5. In other words, the cam surfaces 56, 58 cannot travel over center and produce a continued rotation of shaft 72 even though the door is actually stopped. Should this be allowed to occur it would be necessary to recalibrate the limit switch actuation assembly every time an obstacle of some type affected he operation of the door. It is of course possible to drive the shaft 72 directly from the shaft 18 thus to make the loss of synchronism impossible but this requires a separate drive gear and some method of attaching it to the shaft.

Figure 6:
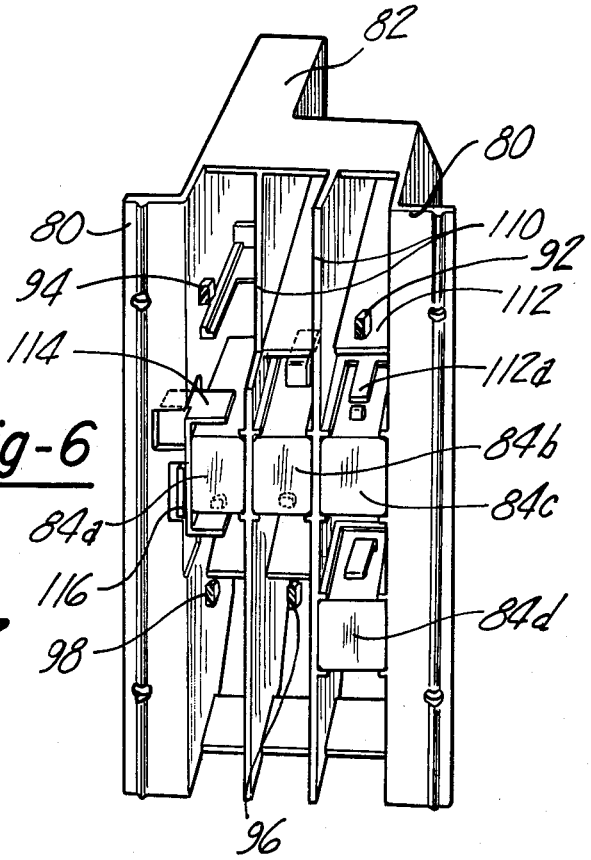
FIG. 6 is a perspective view of a limit switch carrier used in the assembly of FIG. 2.
Figure 7:
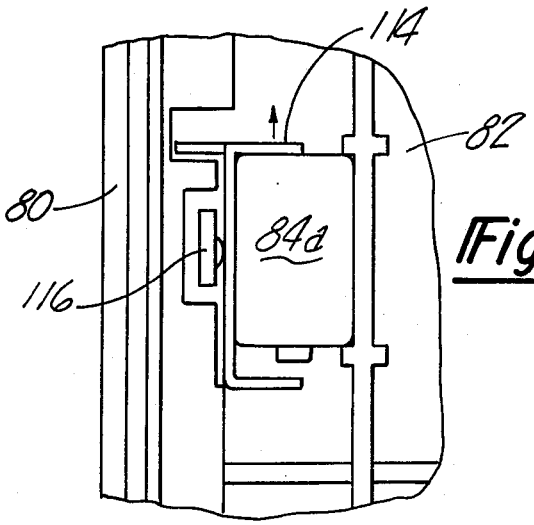
FIG. 7 is a detailed view of a typical limit switch installation assembly.

Looking specifically to the limit switch carrier 82 as best shown in FIGS. 6 and 7 it can be seen that interior dividers 110 are provided for defining three parallel columns of receptacles for limit switches 84. Moreover, internally and integrally molded horizontal dividers 112 are placed in strategic locations to interfere with the actuator buttons and extender arms of the limit switches thus to prevent the switches from being inserted backwards or upside down as well as to prevent a limit switch of one type from being erroneously inserted into the receptacle which is designed for a limit switch of another type. For example, the tab 112A positively prevents a limit switch having an extender arm of the type shown at 84*d* from being inserted into the location for switch 84*c*. The same tab 112A would interfere with the terminal of the switch 84*c* if an attempt were made to insert it backward. Obviously the internal interfering divider configuration may be varied in accordance with the particular type of limit switch employed; the configuration shown in FIG. 6 is designed to work with "Unimax" limit switches, Models 2 TM-4-W and having the specific actuator button and extender arm configuration shown. In the configuration of FIG. 6, switch 84*a* is the down limit switch, switch 84*b* is the safety disarm switch, switch 84*c* is the up limit switch, and switch 84*d* is the light-on/off switch. Again the specific locations are given by way of illustration and are not intended to limit the flexibility of design which might be employed consistent with the various implementations of the invention which are possible.

Figure 10:
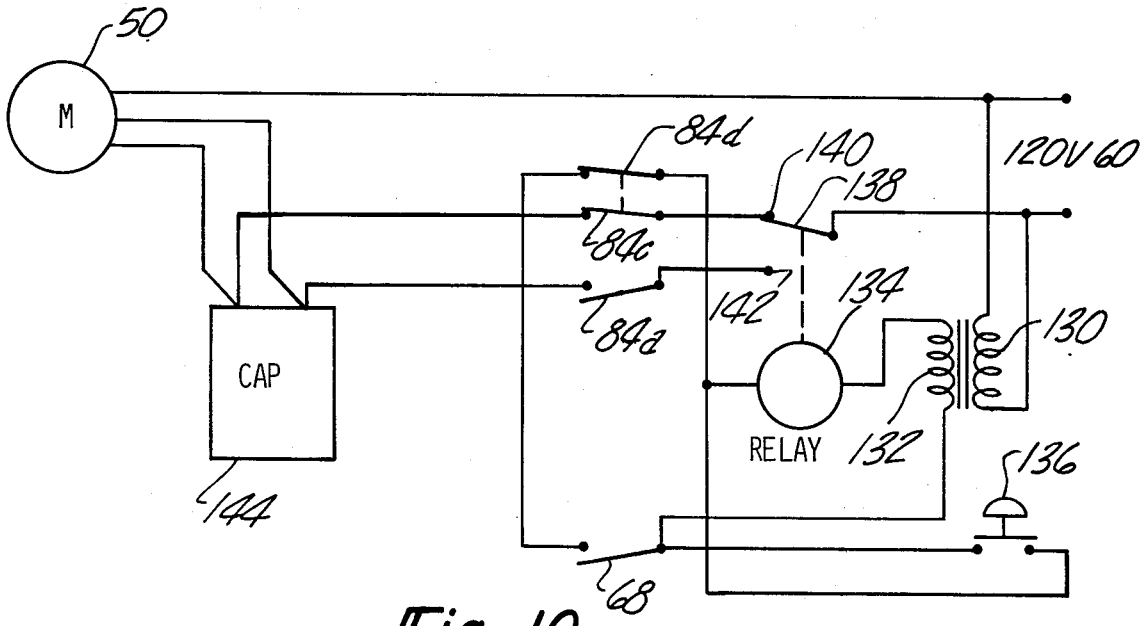
FIG. 10 is a schematic diagram of the motor control circuit.

Looking to FIG. 10, input terminals are connected across a conventional household wiring outlet to provide power to the reversible P.S.C. (Permonent Split Capacitor) motor 50. The input terminals are connected by the primary coil 130 of a small transformer; secondary coil 132 is connected in series with the coil of a bistable ratchet relay 134 and a spring biased manually actuable pushbutton 136. Pressing button 136 causes a surge of current through relay 134 toggling two-position armature 138 between contacts 140 and 142. When on contact 140, the armature 138 directs current from the supply through the down limit switch 84*c* and motor 50. A second input phase to motor 50 by way of capacitor 144 to produce rotation in a direction to drive the door toward the down limit.

The next current surge caused by depressing button 136 causes relay 134 to toggle armature to contact 142 to complete a circuit to motor 50 through the up limit switch 84*a*. The direction of motor rotation is then reversed by reason of shifting the capacitive supply phase from 90° leading the phase to 90° lagging the line phase. Direction of motor rotation is reversed each time armature 138 is toggled. The actual energization of motor 50, however, depends on the condition of the limit switches 84*a* and 84*c*.

The limit switches 84*a* and 84*c* are of the normally closed type; i.e., they form a closed circuit connection unless the actuators thereof are depressed by the dogs of the plates 90 and 91 as traveler 86 moves along shaft 72. Th relay 134 may be purchased from the Ingraham Industries Division of McGraw Edison, Briston, Conn., their model No. C6909A. There are many other sources.

A still further feature of the invention comprises the small three-sided plastic element 114 which is jam-fit between a spring tab 116 formed integrally with the carrier body 82 and the down limit switch 84*a* as best shown in FIG. 6. The plastic element 114 is operated by dogs 94 and 98, and serves as a "memory device" to hold the actuator button of the down limit switch 84*a* in the depressed condition after reaching the down limit even though the door has started back up. During upward travel of the door, a second operation of the radio control or push button control will therefore merely stop the motor 50 rather than producing the instant reverse function; i.e., armature 138 toggles but switch 84*a* remains open circuited. Moreover, a third operation of the push button control or radio control will restart the door in the up direction by toggling armature 138 back to contact 142. This permits the door to be partially opened to allow animals to go into or out of the garage, to allow a breeze to pass under the garage door, or for various other reasons.

Element 114 is moved away from the position depressing the switch actuator by dog 94 just before the door reaches the up limit.

It is to be understood that the subject invention may be implemented in various ways and that the foregoing description is not to be construed in a limiting sense C. Operation In a typical operation, the door is raised by pressing button 136 to start motor 50 in the circuit including the up limit switch 84*c.* Rotation of wheel 42 on shaft 18 rotates shaft 72 until dog 92 reaches the actuator button of the up limit switch 84*a.* When the dog presses the button, the motor circuit is broken. Another depression of button 136 toggles armature 138 and restarts motor 50 through down limit switch 84*a.* If no obstacle is encountered, the door travels normally until dog 98 opens the down limit switch 84*c.* If an obstacle is encountered, overload cam (second cam element) shifts axially due to the ramp effect of the cam surfaces 56, 58 and trips switch 68 to recycle relay 134 to instantly reverse the door.

D. Disconnect for Manual Operation

Figure 11:
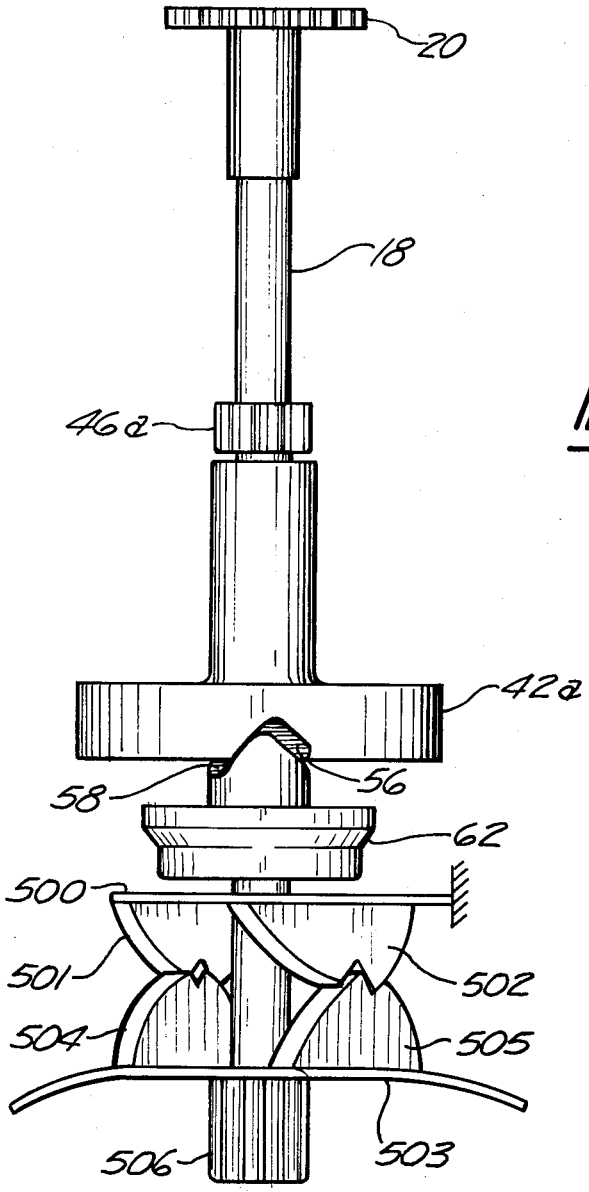
FIG. 11 is a side view of a modification of the structure of FIG. 2 having a manual operation feature; and, FIG. 12 is a plan view of a rolling curtain door having the operator of FIG. 11 attached thereto.

FIG. 11 discloses a modified form of the operator assembly of FIGS. 1 and 2 wherein a disconnect feature for manual operation is provided. The apparatus of FIG. 11 is designed to prevent a loss of limit switch synchronism during manual rotation of shaft 18 such as occurs when the door to which sprocket 20 is connected is raised or lowered by hand.

The apparatus of FIG. 11 comprises the same shaft 18 and sprocket 20 as in the previously described embodiment. However, here the worm wheel 42*a* and the pinion 46*a* which drives the limit switch shaft are non-integral. Moreover, wheel 42*a* has a cylindrical interior surface so as to be fully rotatable about shaft 18. Pinion 46*a* is fixed to shaft 18 to rotate therewith at all times. Cam member 62 is fixed to rotate with shaft 18 but may slide along the shaft as hereinafter described.

Entirely new to the apparatus of FIG. 11 is a bracket 500 carrying two plastic cam blocks 501 and 502; bracket 500 is braced against the gear case body 32 so that it may move axially along shaft 18 but it cannot rotate. A second stamped steel member 503 carries identical cam blocks 504 and 505 which engage blocks 501 and 502 to form a variable length spacer. The ramp-like teeth of the four cam blocks provide a mechanical spacer of maximum length between cam member 62 and stop 506 when engaged, and a spacer of minimum length when disengaged.

In normal operation, the cam block teeth are engaged such that cams 56 and 58 of elements 42*a* and 62 are fully engaged to provide torque transfer from wheel 42*a* to shaft 18 via member 62. In this condition, one cannot manually turn shaft 18 by raising or lowering the door since the mechanical advantage of the operator gear set works against the turning force. To provide manual operation, cam blocks 501, 502, 504, and 505 are disengaged by rotating bracket 503 to reduce the spacer length and disconnect cams 56 and 58. Now the shaft need not turn wheel 42*a* and the door is easily moved. Pinion 46*a* moves with shaft 18 to maintain correlation between door position and limit switch operation. Note that the instant reverse is eliminated.

Figure 12:
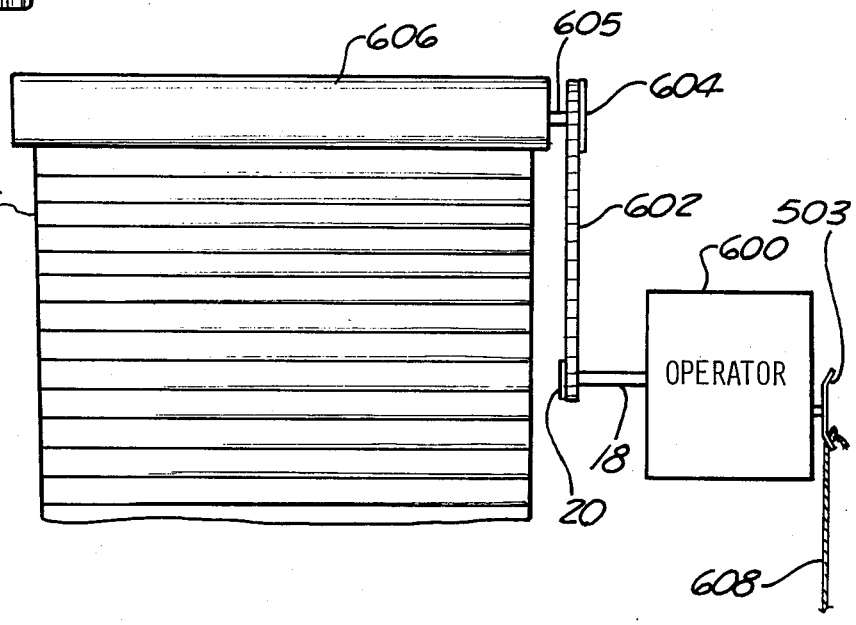

FIG. 12 shows the application of an operator 600 having the features of FIG. 11 to a rolling curtain door 607. In such an operation, a mechanical disconnect in the drive link between operator and door is not conveniently provided; hence, the apparatus of FIG. 11 is used to provide a disconnect between the operator motor and drive shaft 18.

In FIG. 12, operator 600 is mounted with shaft 18 horizontal; sprocket 20 is linked to door roller sprocket 604 via chain 602. Sprocket 604 is connected to shaft 605 which extends through a roller housing 606 which receives articulated door 607 as it is rolled up. Bracket 503 is provided with radial ears for connection to a pull rope 608 to disconnect the cam blocks as previously described.

FIG. 12 is representative of but one of several possible applications of the operator of this invention and FIG. 11 is representative of but one variation in construction. Various other applications and structural variations will occur to skilled persons and, hence, the specific descriptions herein are not to be construed as limiting in effect.

The embodiments of the invention in which an exclusive property or privilege is claimed are defined as follows:

1. In a door operator: a motor for moving the door between up and down limits; an operator body; an output shaft supported by the body for rotation relative thereto: means operated by said shaft for mechanical connection to the door to move the door as the shaft rotates; a first cam element non-rotatably disposed on the shaft and spaced from the operator body; a second cam element loosely rotatably disposed on the shaft for at least limited rotation relative thereto between the first cam element and the operator body and bearing against the operator body; drive means connecting the motor to the second cam element, said first and second cam elements being urged into complemental contact with one another to form a torque coupling between the motor and the shaft capable of transmitting torques less than a predetermined value and responsive to torques in excess of said value to cause said cam elements to slip relative to one another and to cause axial shaft of the first cam element away from the second element and the body; and means carried by the body responsive to the axial shift of said first element to alter the operation of said motor, the operator further including limit means carried by the body for establishing said up and down limits of door travel, the limit means comprising a threaded shaft rotatably carried by the operator body, drive means connected between the second cam element and the threaded shaft to drive same, limit switch actuator means comprising traveler means threadedly engaging the shaft and responsive to the rotation thereof to move axially therealong a distance related to shaft rotation, first and second switch means electrically connected to the motor for controlling actuation thereof in respectively opposite directions of rotation, said first and second switch means being arranged to be actuated by said traveler at respective positions thereof representing said limits of travel, said second cam element comprising an integrally molded worm wheel of first diameter and having peripheral teeth, a hollow cylindrical portion of second diameter less than the first extending axially from said worm wheel and terminating in a second peripherally toothed gear, said second peripherally toothed gear being mechanically connected to drive the threaded shaft such that the output shaft may shift axially inside of the second cam element without disturbing the mechanical drive between the second cam and threaded shaft.

2. Apparatus as defined in claim 1 wherein said means for establishing limits comprises means for monitoring rotation of said output shaft, first and second switch means electrically connected to the motor for stopping same when actuated, and actuator means controlled by the monitor means for actuating one of said switch means to stop the motor at respective limits of travel.

3. Apparatus as defined in claim 1 wherein the monitor means comprises a threaded shaft carried for rotation relative to the operator body, drive means connected between the second cam element and the threaded shaft to drive same, said actuator means comprising traveler means threadedly engaging the shaft and responsive to the rotation thereof to move axially therealong a distance related to shaft rotation, said switch means being arranged to be actuated by said traveler at respective positions thereof representing said limits of travel such that the cumulative rotations of the output shaft and the threaded shaft are at least substantially equal at all times.

4. Apparatus as defined in claim 1 wherein the operator body comprises first means for supporting the output shaft for rotation therein about an axis, second means for supporting the threaded shaft for rotation about another axis, and third means for supporting the traveler means for linear displacement along said other axis.

5. Apparatus as defined in claim 4 wherein the axes of the output shaft and threaded shaft are spaced apart and parallel.

6. Apparatus as defined in claim 2 wherein said monitor means further comprises a limit switch carrier element mounted on the operator body and carrying a plurality of limit switches adjacent said traveler means, and means for adjusting the contact positions between the travel means and the switches to vary said limits.

7. Apparatus as defined in claim 6 wherein said traveler comprises a body threaded on the threaded shaft, limit switch actuator dogs carried on the body, and adjuster screws connected between the body and dogs for adjusting the positions of the dogs on the traveler body.

8. In a garage door operator, a two-piece molded pastic operator body comprising a first member defining part of a first axial, integral bearing cavity for receiving an output shaft, a thrust bearing surface coaxial with the bearing cavity for providing bearing support for a wheel carried on the output shaft, said first member being formed to define part of a second axial bearing cavity for receiving a threaded limit switch shaft in parallel disposition with the output shaft ahd having integral shaft end bearing surfaces at opposite ends of said cavity, a second member removably fastened to the first member to define complemental second parts of said first and second bearing cavities for completing the support of said wheel and threaded limit switch shaft respectively, and linear slide means on the body adjacent said second cavity for receiving a limit switch actuator slide to be threaded on said threaded shaft.

9. In a garage door operator for powering a door between up and down limits, means for defining said limits and comprising: an operator body, a power output shaft mounted rotatably on the body, a threaded shaft mounted on the body for rotation relative thereto adjacent the power output shaft, gear means for driving the threaded shaft from the power output shaft, a traveler slide on the body, a traveler member disposed on the slide for linear displacement and engaging said shaft whereby said linear displacement is related to rotation of said threaded shaft, adjustable dog means carried on said traveler member, and a carrier member mounted on the body adjacent said traveler slide and carrying limit switches to be actuated by the dogs at selected linear positions of said traveler.

10. Apparatus as defined in claim 9 wherein a said carrier member comprises support means for receiving limit switch bodies in discrete positions, and means for preventing the insertion of limit switch bodies other than in said discrete portions.

11. Apparatus as defined in claim 10 wherein the traveler, dog means and carrier are constructed of molded plastic.

12. Apparatus as defined in claim 11 including a friction member wedged between one of the limit switches and the carrier and engaging the limit switch actuates for holding the switch in a given state, the dog means associated with said one limit switch comprising first and second spaced portions, one portion operating to push the friction member toward the limit switch actuator and the other portion operating to push the friction member away from the limit switch actuator at approximately the opposite limits of travel.

13. Apparatus as defined in claim 9 wherein the traveler comprises an open, partial nut portion which can be snapped onto said threaded shaft.

14. Apparatus as defined in claim 13 wherein said dog means comprises at least a second threaded shaft on the traveler and a separate dog plate having an open, partial nut portion snapped onto said second threaded shaft so that rotation of said second threaded shaft causes linear displacement between the plate and traveler.

* * * * *